US005883936A

United States Patent [19]

Hell et al.

[11] Patent Number: 5,883,936

[45] Date of Patent: Mar. 16, 1999

[54] ROTATING X-RAY TUBE

[75] Inventors: Erich Hell, Erlangen; Peter Schardt, Roettenbach, both of Germany

[73] Assignee: Siemens Aktiengesellschaft, Munich, Germany

[21] Appl. No.: 905,403

[22] Filed: Aug. 4, 1997

[30] Foreign Application Priority Data

Aug. 7, 1996 [DE] Germany ..... 196 31 899.8

[51] Int. Cl.[6] ..... H01J 35/10

[52] U.S. Cl. ..... 378/125; 378/119

[58] Field of Search ..... 378/125, 119

[56] References Cited

U.S. PATENT DOCUMENTS 4,357,586 11/1982 Barkow et al. .

4,993,053 2/1991 Rand et al. .

FOREIGN PATENT DOCUMENTS 87 13 042.4 9/1989 Germany .

*Primary Examiner*—Craig E. Church
*Attorney, Agent, or Firm*—Hill & Simpson

[57] ABSTRACT

An x-ray tube has an evacuated housing rotatable around a rotational axis with a cathode and an anode being rigidly mounted in the housing so as to rotate therewith. The cathode emits electrons which are accelerated with an electrical field so as to strike the anode. An electromagnetic system for deflecting and focusing the electron beam has a number of current-permeated coil elements, whereby the coil elements are arranged a common carrier that at least partially surrounds the housing.

10 Claims, 2 Drawing Sheets

ROTATING X-RAY TUBE

BACKGROUND OF THE INVENTION

1. Field of the Invention

The present invention is directed to an x-ray tube of the type having an evacuated housing rotatable around a rotational axis with a drive arrangement in which, firmly connected to the housing, a cathode that emits electrons and an anode onto which the electron beam accelerated with an electrical field, strikes are arranged, and having a non-rotating (stationary) electromagnetic system for the deflection and focusing of the electron beam that includes a number of current-permeated coil elements.

2. Description of the Prior Art

An x-ray tube of the above type is described in U.S. Pat. No. 4,993,055. In this rotating bulb tube, the elements required for generating the x-radiation, i.e. the cathode and the anode, are firmly connected to the housing and rotate together with it during the operation of the x-ray tube. In order to be able to guide the beam on a predetermined path during the rotation so that the path proceeds quasi stationarily and always strikes the rotating anode in the same focal spot, a stationary electromagnetic system is provided that is fashioned for the deflection as well as for the focusing of the electron beam. According to this patent, this electromagnetic system has four coils, known as quadrupole coils, that are arranged around the housing of the tube and that enable operation in a combined deflection/focusing mode on the basis of corresponding control. In this way, it is possible to control the electron beam and the generated focal spot on the anode from the exterior within broad ranges.

The arrangement and fastening of the individual coil elements represents a significant problem, since the coil elements are to be provided in the region of the housing in as simple a way as possible, but a high alignment precision must be achieved at the same time. U.S. Pat. No. 4,993,055, wherein rectangular coils having large dimensions are employed, does not disclose a satisfactory solution.

SUMMARY OF THE INVENTION

The present invention is to provide an x-ray tube of the type initially described wherein the coil elements can be fixed in a simple way relative to the housing with an alignment precision that is adequate at the same time.

For solving this problem in an inventive x-ray tube having the features initially cited, it is inventively provided that the coil elements are arranged a common carrier that at least partially surrounds the housing.

The coil elements are all arranged at a common carrier, i.e. they are held relative to the housing via a single carrier element. An individual arrangement or fixing is not required since the holding function, and, of course, the alignment function as well, are effected by the common carrier. In an embodiment of the invention, the carrier can be fashioned as a substantially cylindrical ring. This ring may have a gap therein, insofar as possible they lie as close as possible to the housing, so that the spacing from the electron beam is as small as possible. Particularly when the carrier is fashioned as a cylindrical ring, this can be advantageously dimensioned small insofar as the coils are kept correspondingly small. A further significant advantage is comprised therein that the attachment of the carrier is extremely simple. Since the carrier at least partially surrounds the housing, it can simply be slipped onto the housing from the cathode side along the cylindrical neck of the housing, resulting in all coils being positioned with few manipulations. This procedure is particularly recommendable when the carrier is inventively fashioned of one piece. Since, in a further embodiment of the invention, the carrier can be composed of a number of parts, particularly of two parts releaseably secured to one another—i.e, in the case of a cylindrical ring, it is composed of two horseshoe-shaped sub-sections—, it is also possible to assemble the carrier together with the coils respectively located at the halves around the housing, this making the attachment even simpler since the arrangement of the carrier can ensue at any point in time, even when the x-ray tube has already been completely manufactured.

In order to attach the coil elements to the carrier in a simple way, in accordance with the invention pole projections pointing toward the housing are fashioned at the carrier, the coil elements being arranged at these pole projections. Since, as already stated, the coils should lie as close as possible to the housing, these radially inwardly projecting pole projections prove especially advantageous. This is especially true when the coil elements are inventively wound around the pole projections, preferably around their outer ends. Since only a few turns suffice, (minimally one coil turn), the attachment to the coil elements at the pole projections is consequently possible in a simple way. The pole projections can have any shape. It has proven expedient, particularly for fabrication reasons, when the pole projections are substantially rectangular in cross-section.

In order to effect the quadrupole operation, which was already described and is required for the combined deflection and focusing function, as efficiently as possible and with adequate formation of the superimposing fields, the coil elements at the carrier, and possibly the pole projections carrying the coil elements, can be arranged substantially uniformly spaced from one another, i.e. offset by respective angles of 90° relative to one another in the case of four coils.

An iron yoke has proven especially expedient as the carrier.

DESCRIPTION OF THE PREFERRED EMBODIMENTS

Figure 1:
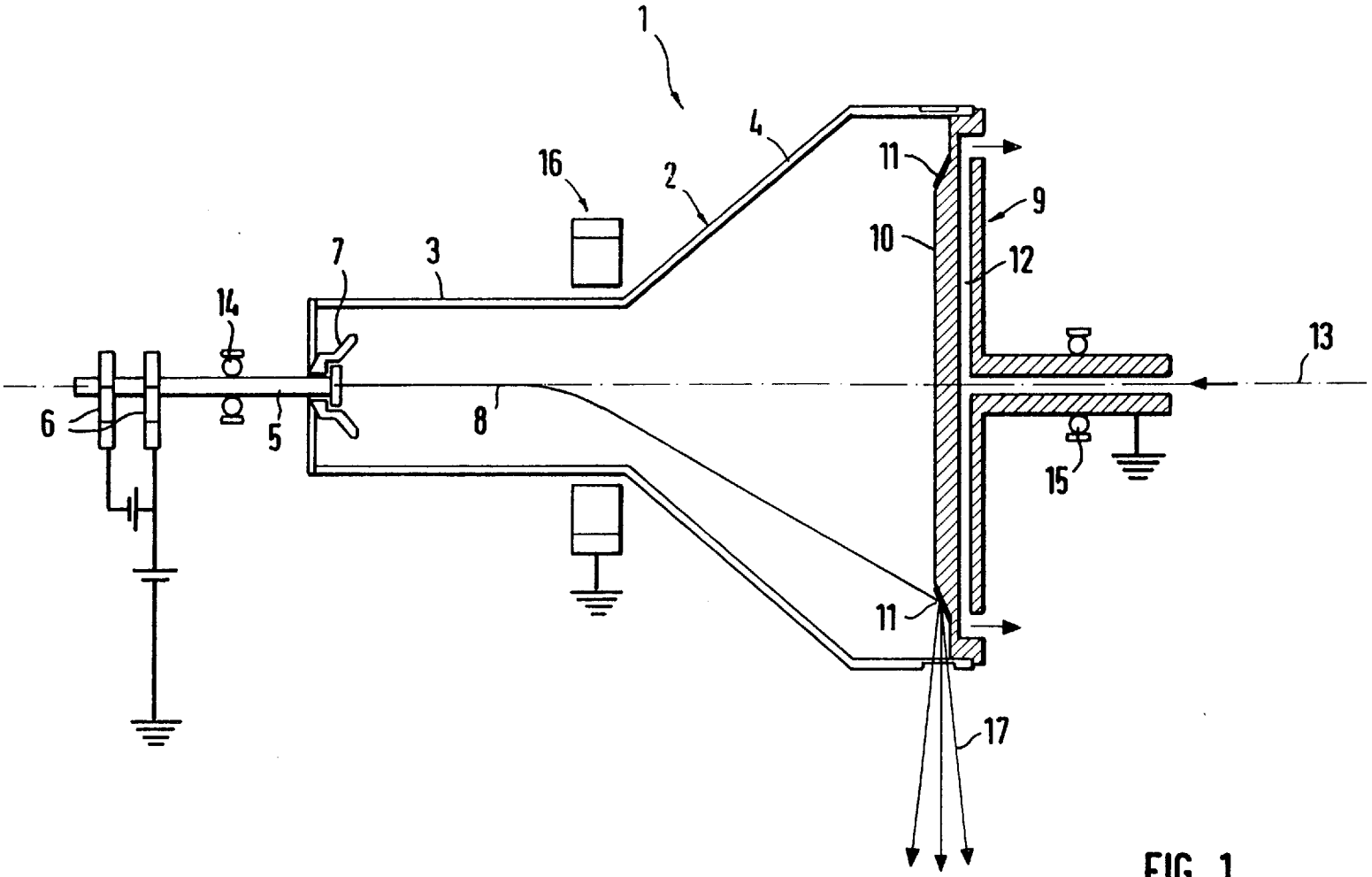
FIG. 1 is a schematic illustration of a rotatable x-ray tube constructed in accordance with the principles of the present invention.

FIG. 1 shows an x-ray tube 1 that has a bulb-like, insulating housing 2 with a substantially cylindrical region 3 and a section 4 adjoining thereto that expands frustum-like. A cathode 5, which is connected via wiper rings 6 to a suitable energy source in order to be placed at negative potential, is arranged at the rear of the housing 2. The cathode 5 has a focusing electrode 7 allocated to it that serves the purpose of setting size of the area (cross-section) of the electron beam that is emitted via the cathode 5 during operation. Such an electron beam is referenced 8 in FIG. 1. An anode 9 that forms a vacuum-tight closure of the housing 2 is provided at that end of the housing lying opposite the cathode 5. The anode 9 has an anode dish 10 with an end section having beveled impingement regions 11 that are occupied with tungsten and which are struck by the electron beam for generating x-radiation, as shall be described later.

The anode 9 has interior channels 12 in order to enable the admission and discharge of cooling fluid that is required for eliminating the thermal energy arising during generation of the x-radiation. The anode 9 itself lies at ground potential, so that an electrical field is established between the cathode 5 and the anode 9, this electrical field serving the purpose of accelerating the emitted electrons in the direction onto the anode 9. The cathode 5 and the anode 9 are arranged along the same rotational axis 13. In order to enable rotation of the x-ray tube 1, the cathode 5 and the anode 13 are rotatably seated with bearing elements 14 and 15. The tube rotation is accomplished with a suitable drive arrangement (not shown).

When x-radiation is to be generated, the thermionic coil of the cathode 5 is energized and heated to its appropriate emission temperature, causing it emit electrons. As a result of the electrical field prevailing between the cathode 5 and the anode 9, the emitted electrons are accelerated in the direction of the anode 9 in the form of the illustrated electron beam 8. Since the electron beam proceeds on the shortest path in the direction of the anode 9, a system 16 (which shall be described in greater detail later) that serves the purpose of focusing and deflection the electrons, is provided for the deflection of the electron beam 8 onto the impinging regions 11, which are the only regions at which x-radiation can be generated. This system makes it possible to deflect the electron beam 8—as shown by the curvature of the beam 8, so that it precisely strikes the impinging region 11 and effects the generation of x-radiation 17 thereat. Since the system 16 is stationary relative to the rotating housing, the electron beam 8 is always deflected in the same direction—toward the bottom in the illustrated example—and always strikes the impinging region 11 of the rotating anode 9. As a result of its specific fashioning as a quadrupole system, however, the system 16 simultaneously serves for focusing the electron beam in order to be able to set a line-shaped focal spot.

Figure 2:
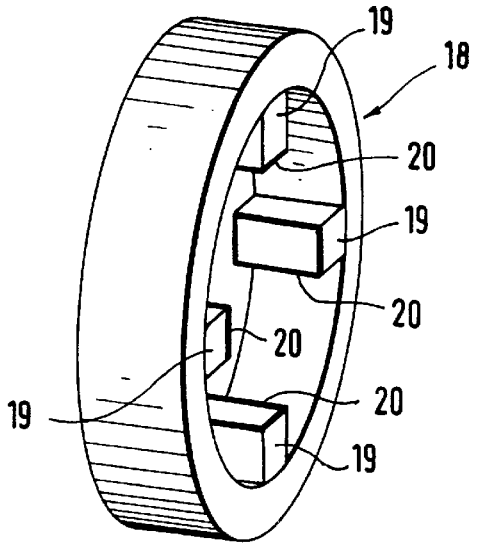
FIG. 2 is a perspective view of the inventive carrier with coil elements arranged thereon.

In a perspective view, FIG. 2 shows the system 16 serving for deflection and focusing in detail. This includes a carrier 18 that is an iron yoke in the illustrated exemplary embodiment. Radially projecting pole projections 19, a total of four, are provided at the inside of this carrier 18, which is cylindrically and circularly fashioned. These pole projections 19 are uniformly spaced from one another by respective angles of 90°. The cross-sectional shape of the pole projections 19 is substantially rectangular. The spacing of the pole projections 19 lying opposite one another, however, is dimensioned such that it just corresponds to the outside diameter of the cylindrical region 3 of the x-ray tube 1, since the carrier 18 is to be arranged around this region 3. Respective coil elements 20 (which are only shown by way of example in FIG. 2) are provided at the ends of the pole projections 19. These coil elements 20, which can be composed of a single turn, are current-permeated and generate the magnetic field that serves the purpose of deflection and focusing. Consequently, the system 16 represents a quadrupole magnet system that is simply constructed and extremely easy to manipulate. This quadrupole magnet system can be effortlessly positioned relatively to the housing 2 of the x-ray tube 1 and secured thereto by slipping the completely configured carrier 18 onto the cylindrical section 3 proceeding from the cathode side. Alternatively to the one-piece embodiment of the carrier 18 shown in FIG. 2, the carrier 18 can be composed, for example, of two parts that are releaseably securable to one another, so that the circular carrier 18 can be opened and the two half-shelves can be simply placed around the region 3.

Figure 3:
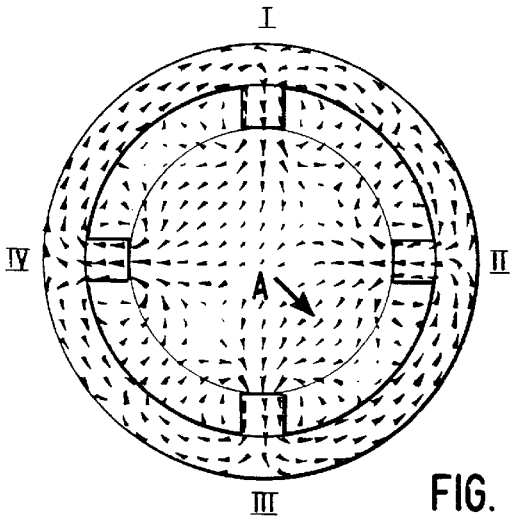
FIG. 3 illustrates the dipole part of the magnetic field produced by the inventive magnetic system.
Figure 4:
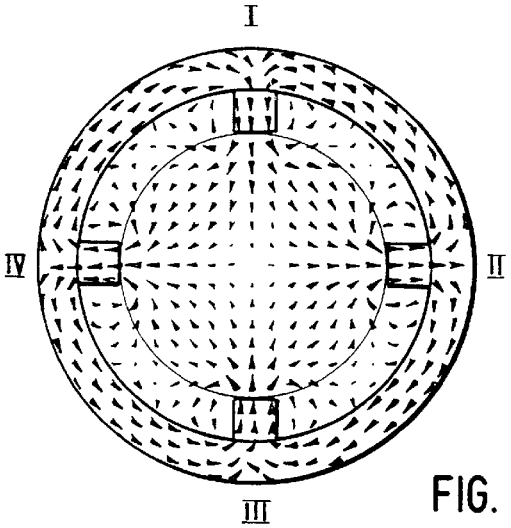
FIG. 4 illustrates the quadrupole part of the magnetic field produced by the inventive magnetic system.
Figure 5:
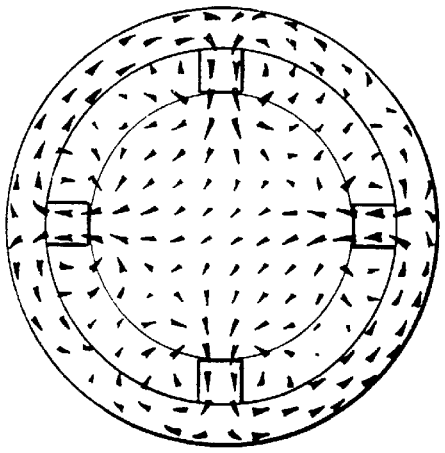
FIG. 5 illustrates the field lines given superimposition of the two field parts of FIGS. 3 and 4.

FIGS. 3–5 show the individual field components of the magnetic field arising from the quadrupole operation, and their superimposition. FIG. 3 shows the dipole part of the magnetic field that can be generated with the system 16. As can be seen from FIG. 3, four magnetic poles I, II, III and IV are fashioned, as already shown in FIG. 2. For the dipole part of the magnetic field, the poles I and II represent the north pole and the poles III and IV represent the south pole. This is reflected by the indicated field line. The dipole part of the magnetic field serves the purpose of deflecting the electron beam. According to the arrangement shown in FIG. 3, the electron beam would be deflected in the direction of the arrow A.

FIG. 4 shows the quadrupole part of the magnetic field that arises due to the asymmetrical operation of the coil elements. To this end, the coil elements can be operated with two separate current sources, so that the dipole field and the quadrupole field can be set independently of one another; this leads to greater flexibility. Due to the asymmetrical operation, the poles I and III are the north pole in this case, whereas the poles II and IV are the south pole. This is also shown by the field lines. The quadrupole field thereby has the property—and the focusing effect results therefrom—of defocusing the electron beam in the deflection direction, i.e. the electron beam is pulled apart in the direction of the arrow A from FIG. 3*a*. In a direction perpendicular thereto, by contrast, the electron beam is converged, i.e. its width is diminished. The setting of a line focus is possible in this way. The area of the electron beam is thereby not altered, only the ratio of length to width. The size itself can be set only with the focusing electrode 7.

The division of the magnetic field into a dipole part and a quadrupole part is possible due to the asymmetrical drive of the coil elements, i.e. the respective coil currents are appropriately set in terms of their size. The following would apply in the illustrated exemplary embodiment:

$I_D$=a $I_Q$=b, whereby $|a|>>|b|$ with $I_D$=excitation current of the dipole part, $I_Q$=excitation current of the quadrupole part, a, b=imaginary current quantities.

The following is then valid for the respective drive currents of the individual coil elements:

$I_I$=a+b $I_{II}$=a−b $I_{III}$=−a+b $I_{IV}$=−a−b, whereby $I, \ldots I_V$=coil-individual excitation currents.

In this way, a magnetic field is generated that is composed of the two different dipole and quadrupole parts. By superimposition of a two field parts according to FIG. 3 and FIG. 4, the magnetic field shown in FIG. 5 is obtained.

Although modifications and changes may be suggested by those skilled in the art, it is the intention of the inventors to embody within the patent warranted hereon all changes and modifications as reasonably and properly come within the scope of their contribution to the art.

We claim as our invention:

1. A rotating x-ray tube comprising:

an evacuated housing;

drive means for rotating said housing around a rotational axis;

a cathode in said housing which emits electrons;

an anode in said housing at a potential relative to said cathode for causing said electrons to be accelerated from said cathode toward said anode so as to strike said anode and produce x-rays at said anode; and stationary electromagnetic means for deflecting and focusing said electrons, said electromagnetic means comprising an iron yoke carrier disposed outside of and at least partially surrounding said housing, said carrier supporting a plurality of current-carrying coil elements arranged in a quadrupole arrangement.

2. A rotating x-ray tube as claimed in claim 1 wherein said carrier comprises a substantially cylindrical ring.

3. A rotating x-ray tube as claimed in claim 1 wherein said carrier comprises a plurality of pole projections extending toward said housing, said coil elements being respectively carried by said pole projections.

4. A rotating x-ray tube as claimed in claim 3 wherein said coil elements are wound around respective pole projections.

5. A rotating x-ray tube as claimed in claim 4 wherein each pole projection terminates at an end adjacent said housing, and wherein said coil elements are wound around the respective pole projections at the respective ends thereof.

6. A rotating x-ray tube as claimed in claim 3 wherein said pole projections each has a substantially rectangular cross-section.

7. A rotating x-ray tube as claimed in claim 3 wherein said coil elements and said pole projections are disposed substantially uniformly spaced from each other around said carrier.

8. A rotating x-ray tube as claimed in claim 1 wherein said coil elements are carried by said carrier at respective positions substantially uniformly spaced from each other around said carrier.

9. A rotating x-ray tube as claimed in claim 1 wherein said carrier comprises a single piece.

10. A rotating x-ray tube as claimed in claim 1 wherein said carrier comprises a plurality of pieces joined to each other.

* * * * *